United States Patent [19]

Zevlakis

[11] 4,023,379

[45] May 17, 1977

[54] DINING TABLE WITH A REFRIGERATED WELL THEREIN AND MEANS FOR USING SAID WELL

[76] Inventor: John Zevlakis, 205 W. Main St., Carrborro, N.C. 27514

[22] Filed: Dec. 29, 1975

[21] Appl. No.: 644,724

[52] U.S. Cl. ..... 62/258; 254/146; 254/156

[51] Int. Cl.[2] ..... F25D 23/12; B66C 23/60; A62D 1/14; B66D 5/16

[58] Field of Search ..... 62/258, 261, 249, 250; 254/146, 156

[56] References Cited

UNITED STATES PATENTS

| | | | |
|---|---|---|---|
| 521,251 | 6/1894 | Allmon | 254/146 |
| 2,627,445 | 2/1953 | Lyon | 62/258 |
| 2,895,311 | 7/1959 | Spaluins | 62/258 |
| 3,112,816 | 12/1963 | Halford | 254/156 |

*Primary Examiner*—Lloyd L. King
*Attorney, Agent, or Firm*—Robert Henderson

[57] ABSTRACT

A pulley arrangement is operable by a person located adjacent to a table to lower a food holding container into a refrigerated well in the table and to raise said container with respect to said well sufficiently to render the contents of the container readily accessible to said person.

1 Claim, 3 Drawing Figures

DINING TABLE WITH A REFRIGERATED WELL THEREIN AND MEANS FOR USING SAID WELL

BACKGROUND OF THE INVENTION

As far as I am aware, compartments have hitherto been provided for storing various kinds of articles underneath a table top, the articles being accessible only from the side of the table; and various other arrangements, usually quite complex, have been suggested for elevating certain other types of compartments bodily and together with a related table top to render the stored articles more accessible. However, it does not appear that any simple means have previously been suggested for elevating a food container from or within a refrigerated well in a table without in any way disturbing the top of the table.

PRINCIPAL OBJECTS OF THIS INVENTION

An important object is the provision of means, within ready control of a person at a dining table, to maintain a selected food (wine, for example) at a desired reduced temperature throughout a meal being partaken at that table.

Wine, or other food which should preferably be served in chilled condition may, by this invention, be kept in its desired chilled condition while being made more readily accessible by manipulation of a pulley arrangement by a person at the table.

BRIEF DESCRIPTION OF THE ACCOMPANYING DRAWING

DETAILED DESCRIPTION OF THIS INVENTION

The Table and Its Appurtenances

Figure 1:
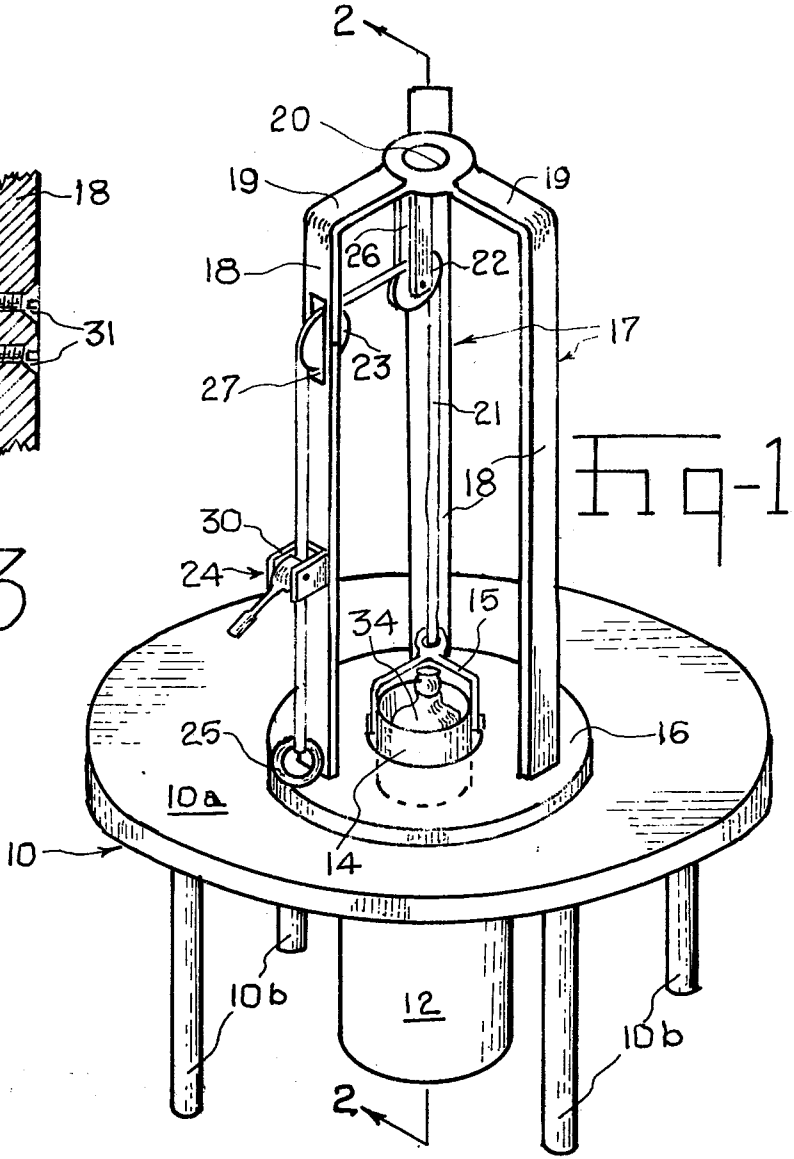
FIG. 1 is a perspective view of a table according to this invention.

A table 10, having a flat top 10*a* and legs 10*b*, is formed with a circular central opening 11 in said top, and is provided with a cylindrical well 12 having a bottom wall 12*a* and a cylindrical side wall 12*b*; said walls having passages 12*c* therein for circulating a fluid refrigerant delivered by pipes 13. The well 12 is suitably fixed to the under side of the table top 10*a* with open upper end 12*d* of the well in vertical alignment with the table top's opening 11.

A food holding container is shown as a bucket 14, provided with a bail 15; the bucket being of such shape and size as to be closely accommodated within the well 12 but, nevertheless, to be easily slidable vertically therein. Such vertical moving of the bucket 14, in the embodiment illustrated herein, is accomplished and controlled by a very simple pulley arrangement now to be described.

The Pulley Arrangement

Optionally, but with some advantage, a flat reinforcing ring 16 is suitable fixed upon the table top 10*a* in alignment with the latter's opening 11 to assure rigid support of the well 12 by the table and also assuring rigid support of an upstanding pulley supporting trestle 17. The trestle 17 is shown as comprising three equidistant, rigid uprights 18, fixed at their lower ends upon the ring 16 and formed with inwardly directed radial portions at their upper ends, rigidly interconnected centrally at a juncture 20.

One end of a pulley cable 21, or equivalent chain or the like, is connected to the bail 15, extends upwardly and over a first pulley wheel 22, thence horizontally over a second pulley wheel 23 and downwardly through a brake mechanism 24 below which the other end of the cable is provided with a suitable hand grip such as, for example, a ring 25.

The first pulley wheel 22 is carried by a suitable pulley block 26 fixedly mounted upon the under side of the trestle juncture 20 to suspend therefrom slightly off center so that the portion of cable 21 coming from the bucket 14 will engage the wheel 22 substantially vertically with respect to the bucket.

The second pulley wheel 23 is shown as mounted within a slot 27 in one of the trestle uprights 18. The downward extension of the cable 21 from the second pulley wheel 23 to the brake mechanism 24 should be approximately vertical.

The Brake Mechanism

Figure 3:
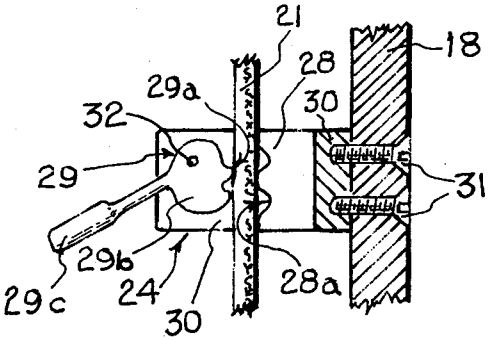
FIG. 3 is an enlargement of the portion included within a broken-line circle in FIG. 2.
Figure 2:
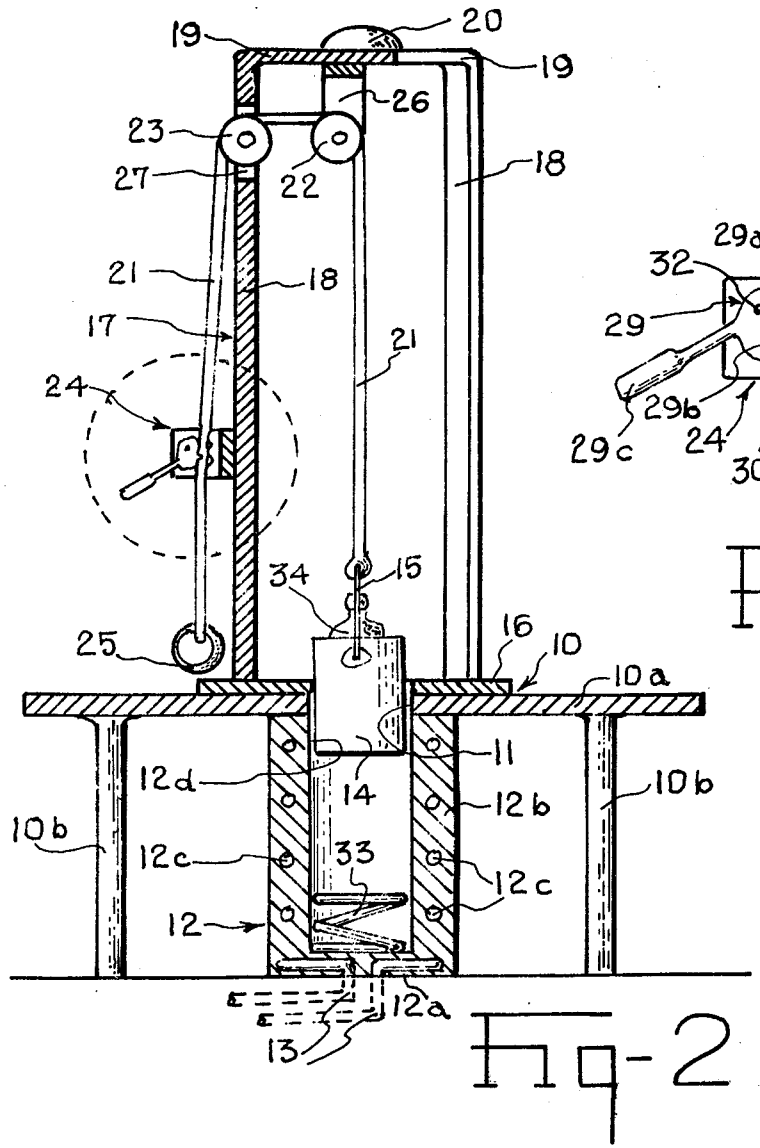
FIG. 2 is a vertical, central, sectional view, substantially on the line 2—2 of FIG. 1.

The brake mechanism 24, best understood from FIG. 3, is shown as comprising a set of coacting braking members 28 and 29, both carried within a U-shaped brake block 30 suitably fixed as, for example, by screws 31 to the same trestle upright 18 in which the pulley wheel 23 is mounted. In running downwardly from the pulley wheel 23, the cable 21 passes between the brake members 28 and 29, being engaged between corrugated surfaces 28*a* and 29*a* of said members.

The brake member 28 is fixed rigidly within the brake block 30 and the brake member 29 has a generally oval body portion 29*b* pivotally mounted, toward its upper end by a pivot pin 32, on the brake block 30. The body portion 29*b* is preferably provided with an integral, weighted extension 29*c* which tends to urge ther brake member 29 counter clockwisely as viewed in FIG. 3, thereby normally holding the latter member's corrugated surface 29*a* against the cable 21 so that the latter is normally engaged between both brake members 28 and 29.

Suitable cushioning means are optionally provided within the well 12, underneath the bucket 14 to avoid shock engagement of said bucket with the bottom wall of the well. Such means are illustrated as a coil spring 33 in the bottom of the well although, alternatively, the same or equivalent cushioning means may be fixed to the bottom of said bucket.

Operation

In use, assuming that the well 12 is in refrigerated condition, an article to be maintained in chilled condition, shown as a bottle 34 of such as cooled wine, is placed in the bucket 14. When a waiter or a diner at the table desires to serve the wine, he pulls downwardly on the ring 25, thereby elevating the bucket 14 to bring its top approximately to or somewhat above the level of the table top 10*a*, making the bottle 34 easily accessible for temporary removal from the bucket to permit service of wine from the bottle.

During such elevating of the bucket 14, the cable 21 slides, without material impediment, between the two brake members 28 and 29 as the sliding of said cable against the member 29 tends to urge it clock wisely, i.e., toward a brake release condition. After the bucket has been elevated and while the wine is being served, the weight of the bucket 14 tends to pull upwardly on the cable at the brake mechanism 24. That tendency, together with the weighted extension 29*c* and resulting slight counter clockwise turning of the brake member 29 cause the corrugated surface 29*a* to engage the cable firmly between it and the corrugated surface 28*a*, thereby holding the bucket in its elevated position.

After the wine or other food has been served, the bottle 34 is replaced into the bucket 14 and the weighted extension 29*c* manually raised slightly to permit the cable 21 to slide in the braking mechanism 24, enabling the bucket 14 to gravitate back into the well 12 to remain there until it is again desired to serve wine or other food from the bucket.

It should be obvious that the disclosed table may be modified in various ways without, however, departing from the invention as set forth in the following claims.

I claim:

1. A dining table having a generally flat top formed with a normally open, approximately central opening therein, a refrigerated compartment formed with a normally open, approximately central top opening and fixed to the under side of the table's top in vertical communication with and approximately in vertical alignment with the latter's said opening, a food holding container adapted for reception within said compartment, and elevating means comprising a pulley assembly coacting with the table's said top and with said container and manually operable at a point adjacent to said table top for vertically shifting said container within said compartment; said pulley assembly including a trestle fixed to said table top and extending thereabove approximately in vertical alignment with said compartment, said pulley assembly being supported by said trestle and including pulley-wheel means at an upper portion of said trestle, a cable, a first portion of which is attached to said container and extends upwardly therefrom to and about said pulley-wheel means, and a second portion of said cable extending downwardly from said pulley-wheel means and adapted for manual operation to move said container vertically within said refrigerated compartment; said table, further, including a brake mechanism carried by said trestle and coacting with said cable to hold said container in an elevated position relatively to said compartment; said brake mechanism comprising coacting brake members having opposed surfaces between which and in braking contact with which said cable extends, spacing between said braking members being manually adjustable to reduce the braking effect of said braking contact; one of said brake members being fixed to said trestle, and another of said brake members, carried by said trestle and movable relatively to said fixed brake member, being yieldably biased to urge its said opposed surface toward the said opposed surface of said fixed brake member to brake the movement of said cable, and said movable brake member being manually movable oppositely to said biasing to reduce said braking effect; said movable brake member being generally oval and so pivotally mounted eccentrically as to permit said cable to slide relatively unimpeded in one direction between said opposed surfaces during operation of said pulley assembly to elevate said container, while holding said cable against material movement between said opposed surfaces in the opposite direction to hold said container in an elevated position; and said movable brake member further including an integral, weighted extension, accentuating said biasing of said movable brake member, and constituting a handle of the movable brake member, facilitating manipulation of the latter to oppose said biasing.

* * * * *